US007621747B1

(12) United States Patent
Burrow

(10) Patent No.: US 7,621,747 B1
(45) Date of Patent: Nov. 24, 2009

(54) LASER STABILIZATION ASSEMBLY FOR WEAPON SIMULATORS

(75) Inventor: Robert Burrow, Norcross, GA (US)

(73) Assignee: Meggitt Training Systems, Inc., Suwanee, GA (US)

( * ) Notice: Subject to any disclaimer, the term of this patent is extended or adjusted under 35 U.S.C. 154(b) by 1027 days.

(21) Appl. No.: 11/141,629

(22) Filed: May 31, 2005

Related U.S. Application Data

(60) Provisional application No. 60/575,443, filed on May 28, 2004.

(51) Int. Cl.
*F41F 27/00* (2006.01)

(52) U.S. Cl. ..... 434/21; 434/19

(58) Field of Classification Search ..... 434/19, 434/21, 22; 42/114, 115, 116
See application file for complete search history.

(56) References Cited

U.S. PATENT DOCUMENTS 3,633,285 A 1/1972 Sensney
3,938,262 A 2/1976 Dye et al.
3,995,376 A 12/1976 Kimble et al.
4,281,993 A * 8/1981 Shaw ..... 434/22
5,299,375 A * 4/1994 Thummel et al. ..... 42/115
5,432,598 A * 7/1995 Szatkowski ..... 356/153
5,842,300 A * 12/1998 Cheshelski et al. ..... 42/116
6,473,980 B2 * 11/2002 Ripingill et al. ..... 33/506
6,579,098 B2 * 6/2003 Shechter ..... 434/21
6,742,299 B2 * 6/2004 Strand ..... 42/134
6,793,494 B2 * 9/2004 Varshneya et al. ..... 434/21
6,869,285 B1 * 3/2005 Jones, II ..... 434/16
6,966,775 B1 * 11/2005 Kendir et al. ..... 434/19

* cited by examiner

*Primary Examiner*—Kurt Fernstrom
(74) *Attorney, Agent, or Firm*—Smith Gambrell & Russell LLP

(57) ABSTRACT

A laser stabilization assembly for weapon simulators is used in conjunction with the weapon simulator to steady a laser module. The laser stabilization assembly includes a first spacer, a second spacer and a lock ring that is secured to the barrel of the weapon simulator via a threaded insert and locking components. The assembly is mounted proximate to the barrel of the weapon simulator in the same general area allocated for a conventional laser apparatus of a conventional weapon simulator.

16 Claims, 9 Drawing Sheets

LASER STABILIZATION ASSEMBLY FOR WEAPON SIMULATORS

CLAIM OF PRIORITY

This application claims priority from U.S. Provisional Patent Application Ser. No. 60/575,443, filed on May 28, 2004, which is incorporated herein in its entirety.

BACKGROUND OF THE INVENTION

The firearms training industry has, for a number of years, trained individuals in the use of firearms by using systems that incorporate simulated weapons and simulated scenarios. Typically, these systems present a trainee with simulated situations which require the trainee to exercise judgment in determining when and where to fire a simulated weapon. The simulated situations are typically produced as an interactive cinematic environment using videotaped situations with actual people and locations to create a realistic environment for the trainee. Throughout the cinematic experience, the systems detect and record the location of each "shot" fired by the trainee in relation to the position of the character to which the shot was directed.

In such systems, the detection and location of a trainee's shot is often accomplished through use of a simulated weapon that works in conjunction with data acquisition equipment. The simulated weapon and data acquisition equipment may take on various forms. For example, in one weapons training system, the simulated weapon may employ a laser light source to generate a spot on the screen (or reflective surface) when the weapon is aimed and fired by the trainee. The data acquisition equipment employs an area array image sensor, such as a Charge Coupled Device (CCD) camera, to detect and locate the position of the laser spot when it is directed upon the screen by the trainee.

To accomplish these tasks, the CCD camera is aimed at the screen to constantly receive an updated image consisting of light reflected from the screen. Before entering the CCD camera, the reflected light passes through a filter that prevents passage of all light not having a wavelength equal to that of the laser light. Thus, only reflected light from the laser spot actually enters the CCD camera where it is imposed on a sensor surface comprised of individual CCD sensors arranged in a two-dimensional array (or row and column grid) like the discrete pixels on a computer monitor or television screen. When struck by the reflected light of the laser spot, the sensors produce an electrical signal corresponding to the intensity of the light received by the sensors. By scanning all of the sensors in the sensor array one row after another, the current image received by the CCD camera is converted into a plurality of discrete electrical signals or pixels. The presence and location of a laser spot is determined by subsequent analysis of the acquired pixel data.

Other firearms training systems enable multiple individuals to be trained simultaneously as a team using similar simulated weapons and data acquisition equipment. To detect and distinguish between multiple weapons that may be fired at the same time by multiple trainees, some systems employ simulated weapons having a laser light source which is modulated at a preset frequency. By modulating the lasers of the different weapons in the system at different preset frequencies, appropriate data acquisition equipment is able to distinguish a laser spot generated by one weapon from the laser spots generated by the other weapons.

Various patents disclose the use of laser or other light energy with firearms to simulate firearm operation. For example, U.S. Pat. No. 3,633,285 discloses a laser transmitting device for marksmanship training. The device is readily mountable to the barrel of a firearm, such as a rifle, and transmits a light beam upon actuation of the firearm firing mechanism. The laser device is triggered in response to an acoustical transducer detecting sound energy developed by the firing mechanism. The light beam is detected by a target having a plurality of light detectors, whereby an indication of aim accuracy may be obtained.

Another patent, U.S. Pat. No. 3,938,262, discloses a laser weapon simulator that utilizes a laser transmitter in combination with a rifle to teach marksmanship by firing laser bullets at a target equipped with an infrared detector. The laser weapon includes a piezoelectric crystal coupled to a laser disposed in a housing for mounting axially to a rifle barrel. The rifle may develop a mechanical force by firing a blank cartridge which generates a shock wave and vibrates the piezoelectric device.

Finally, U.S. Pat. No. 3,995,376 discloses a miniaturized laser apparatus mounted on a weapon, where the power source and circuitry for the laser apparatus are contained within the weapon. The laser weapon is fired in a normal manner by squeezing the trigger while aiming at a target.

In each of these training systems, where lasers are used to measure the accuracy of the shooter, is it important that the laser light source be properly aligned with the direction of the barrel of the weapon simulator so that the laser will follow the same path as a projectile of an actual firearm. This is problematic, in that even when the light source is properly aligned in the barrel initially, the laser light source may drift or move within the barrel during operation of the firearm, and create an inaccurate result. Specifically, recoil in the firearm can sometimes create movement in the laser light source that misaligns the laser light from the projected path of fired ammunition. Thus, when the laser is misaligned with the direction of the barrel of the weapon simulator, inaccurate results are obtained.

In attempting to prevent movement of the laser light source within the firearm barrel, several solutions have been proposed. One such solution includes the application of an adhesive material to the laser light source to keep it secure within or to the firearm barrel. A problem with such a solution is that the use of adhesive materials could cause the laser light source to receive the full impact of recoil of the firearm, which would lead to the premature failure of that laser light source. In addition, the adhesive materials would prevent or substantially hinder the removal of the laser light source from the barrel of the firearm, such that repair or improvements to the firearm would be difficult.

SUMMARY OF THE INVENTION

A laser stabilization assembly for firearms is used in conjunction with a firearm to steady a laser module. The laser stabilization assembly includes a first spacer, a second spacer and a lock ring that is secured to the barrel of the firearm via a threaded insert and locking components. The assembly is mounted proximate to the barrel of the firearm in the same general area allocated for a conventional laser apparatus of a conventional weapon simulator.

DETAILED DESCRIPTION OF THE DRAWINGS

A laser stabilization assembly for firearms is illustrated in the following drawings.

Figure 1:
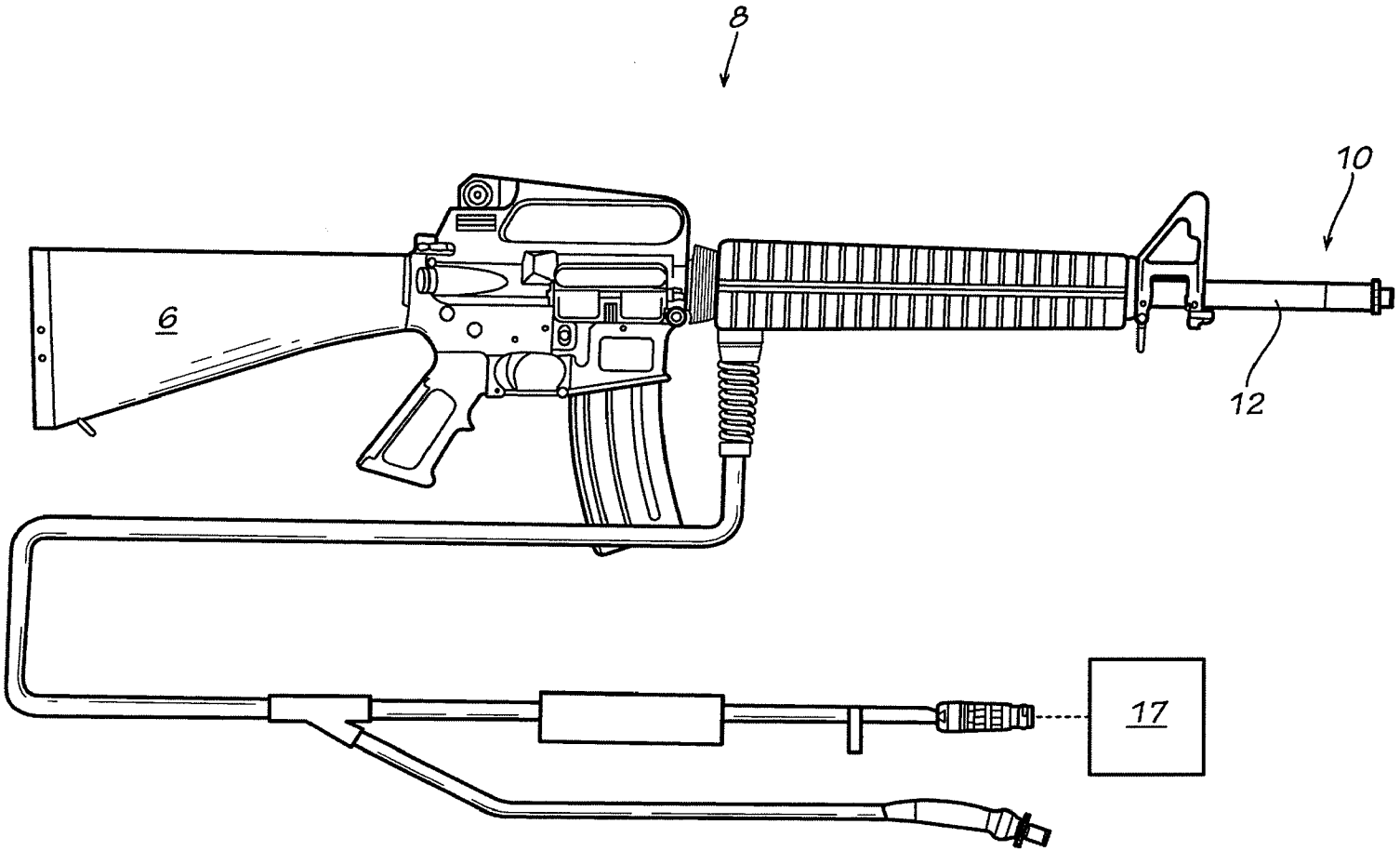
FIG. 1 is a side elevational view of the laser stabilization assembly of the present invention attached to a firearm.
Figure 2:
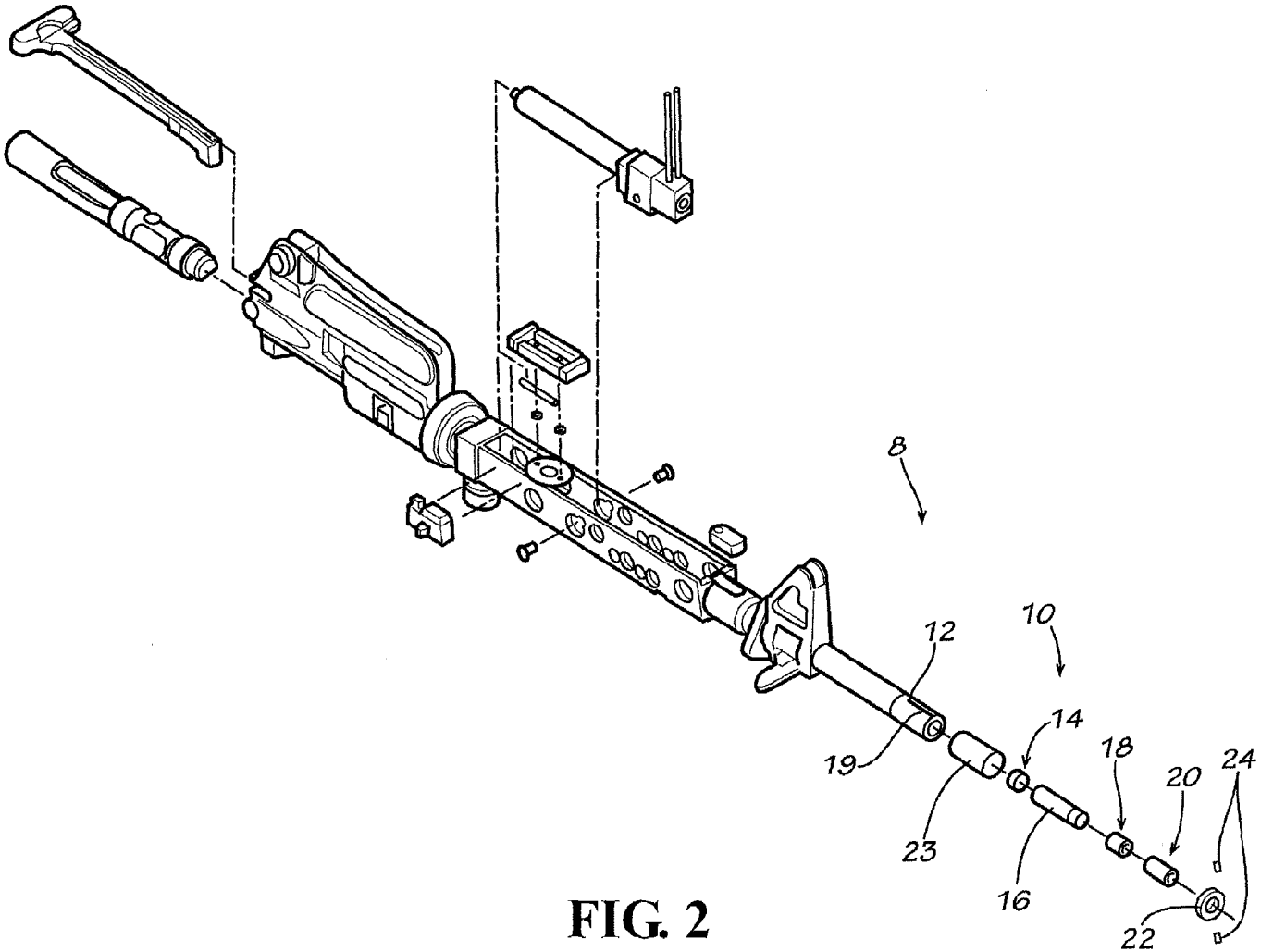
FIG. 2 is an exploded view of the view illustrated in FIG. 1.
Figure 3A:
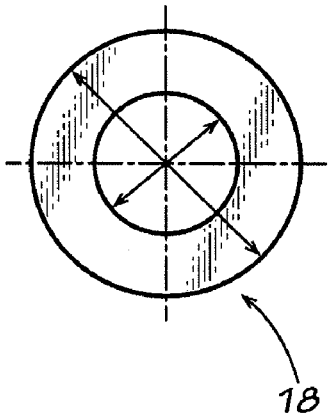
Figure 3B:
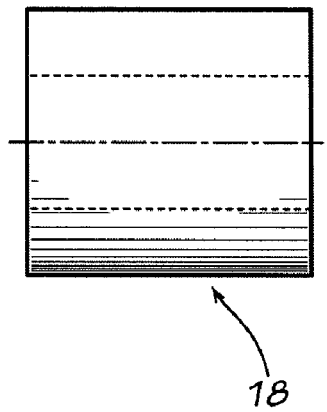

FIG. 3*a* is a front elevational view of a second or distal spacer of the laser stabilization assembly of the present invention;

FIG. 3*b* is a side elevational view of the second spacer illustrated in FIG. 3*a;*

Figure 3C:
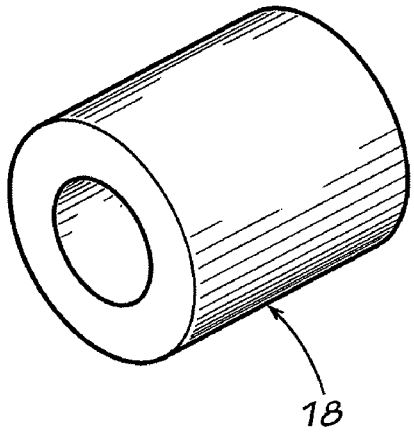

FIG. 3*c* is a perspective view of the second spacer illustrated in FIG. 3*b;*

Figure 4A:
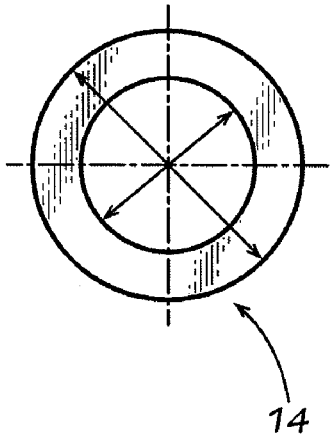
Figure 4B:
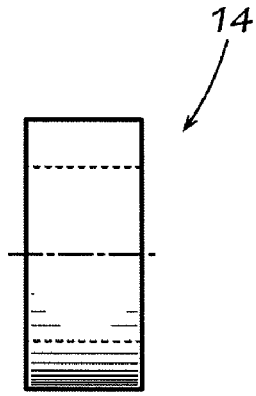

FIG. 4*a* is a front elevational view of a first or proximal spacer of the laser stabilization assembly of the present invention;

FIG. 4*b* is a side elevational view of the first spacer illustrated in FIG. 4*a;*

Figure 4C:
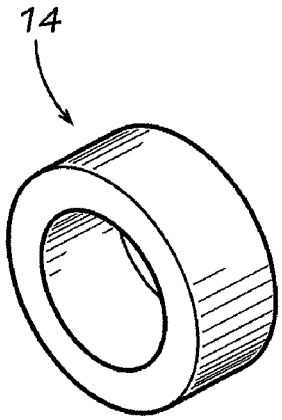

FIG. 4*c* is a perspective view of the first spacer illustrated in FIG. 4*b;*

Figure 5A:
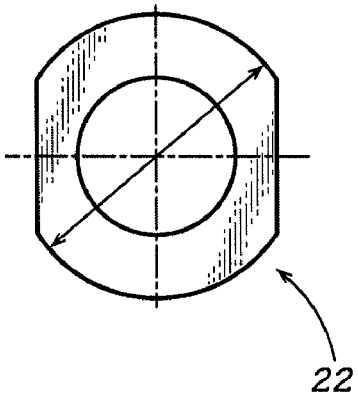
Figure 5B:
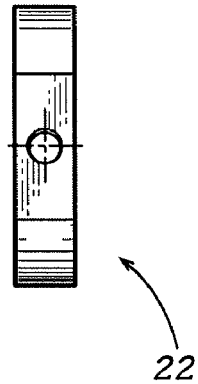

FIG. 5*a* is a front elevational view of a lock ring of the laser stabilization assembly of the present invention;

FIG. 5*b* is a side elevational view of the lock ring illustrated in FIG. 5*a;*

Figure 5C:
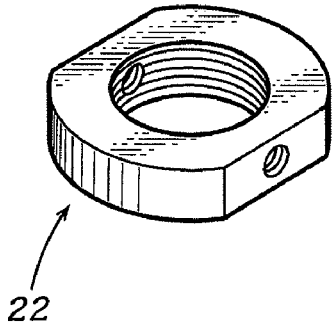

FIG. 5*c* is a perspective view of the lock ring illustrated in FIG. 5*b;*

Figure 6B:
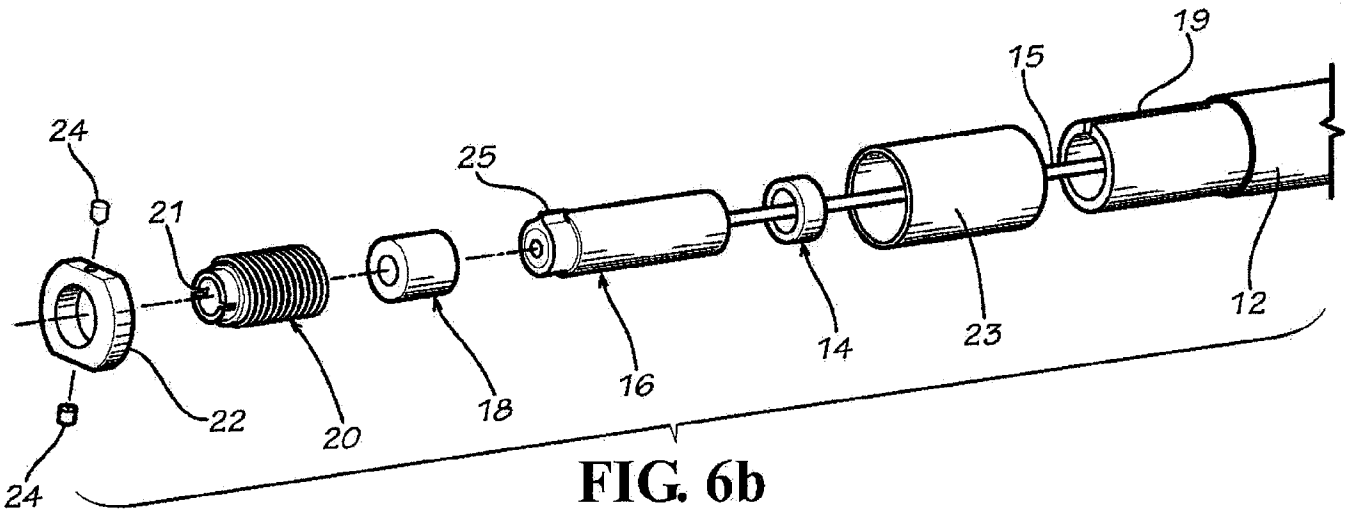
Figure 6A:
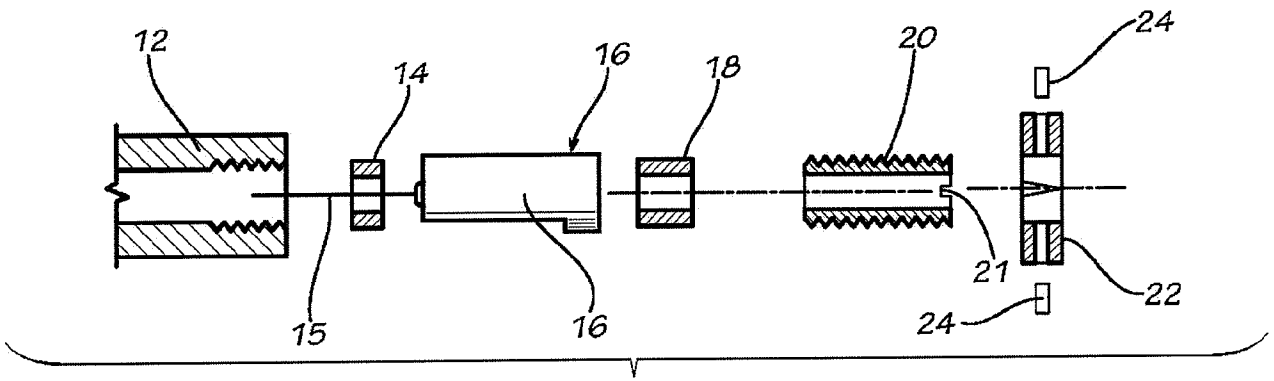
Figure 7:
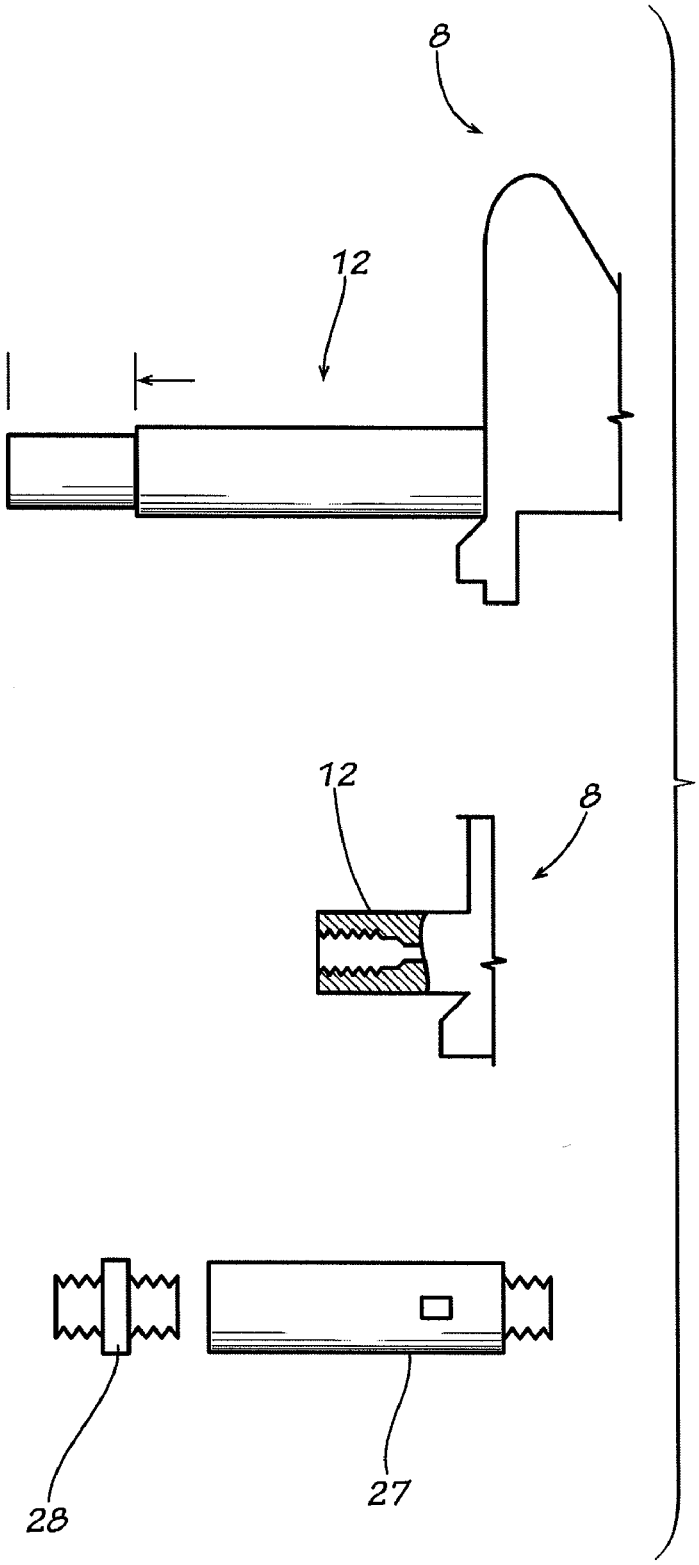
Figure 8A:
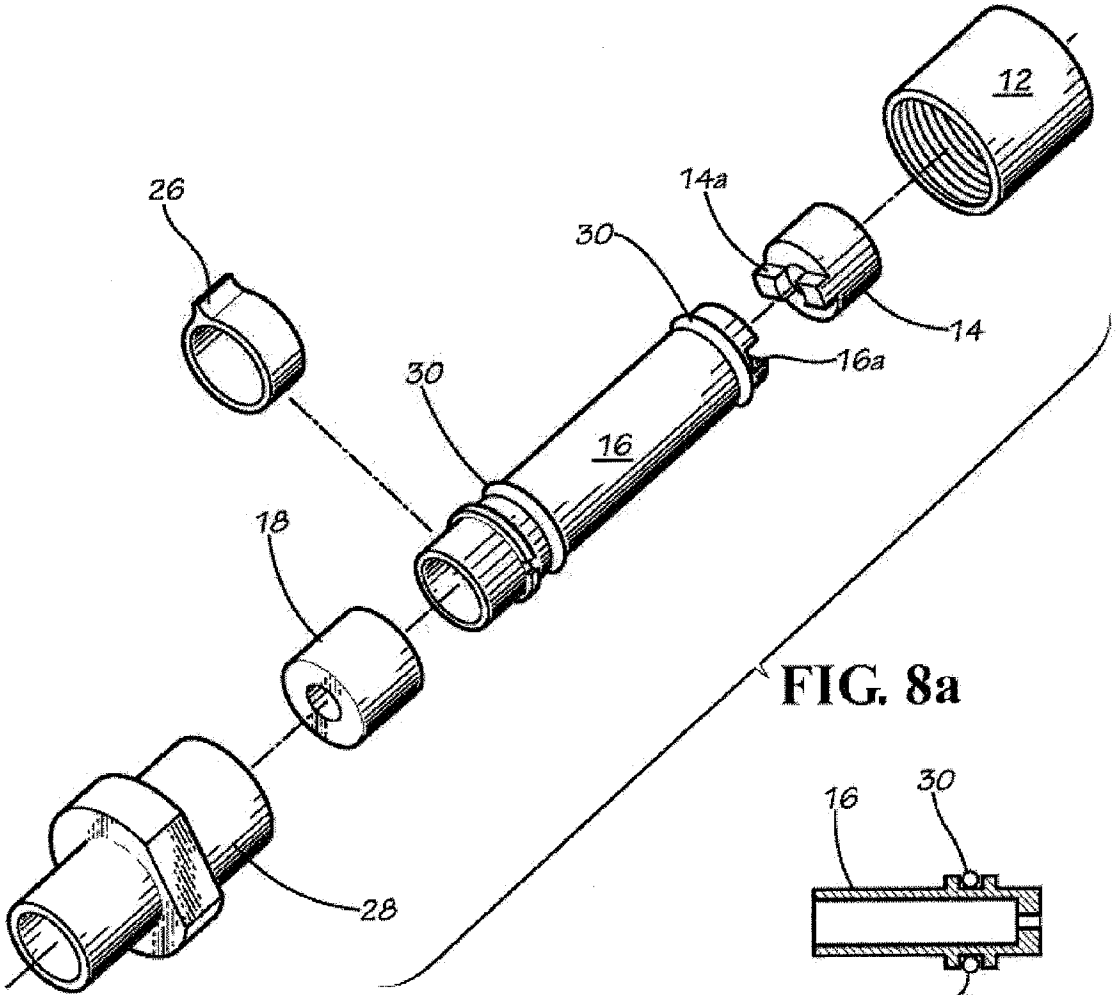
Figure 8B:
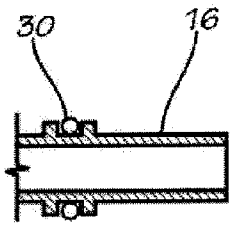
Figure 8C:
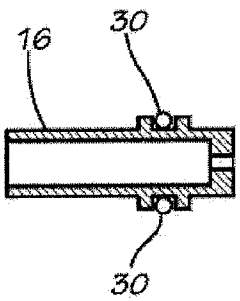
Figure 8D:
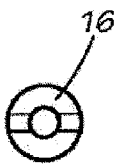
Figure 9A:
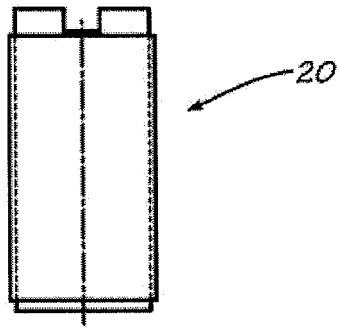

FIG. 6*a* is an exploded sectional view of the laser stabilization assembly of the present invention;

FIG. 6*b* is an exploded view of the laser stabilization assembly of the present invention;

FIG. 7 is an illustration of an adapter used as the retainer of a variation of the laser stabilization assembly;

FIG. 8*a* is an exploded view of an alternative mounting of the laser stabilization assembly with the weapon barrel;

FIGS. 8*b* and 8*c* are side sectional views of the laser apparatus;

FIG. 8*d* is an end elevational view of the laser apparatus;

FIG. 9*a* is a side elevational view of a barrel guide; and

Figure 9B:
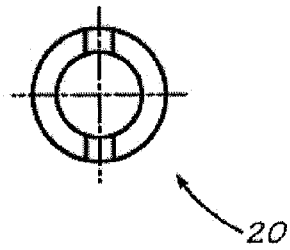

FIG. 9*b* is a top plan view of the barrel guide illustrated in FIG. 9*a.*

DESCRIPTION OF THE INVENTION

Looking now to FIGS. 1-9*b*, the present invention for a laser stabilization assembly 10 is illustrated in conjunction with a weapon simulator 8. More specifically, looking at the laser stabilization assembly 10 illustrated in FIG. 2, the laser stabilization assembly 10 includes a first or proximal spacer 14 (see FIG. 4), a second or distal spacer 18 (see FIG. 3) and a lock ring 22 (see FIGS. 5 and 6) that is secured to the barrel 12 of the weapon simulator 8 via a threaded insert 20 and locking screws 24 or similar locking components. The laser stabilization assembly 10 is mounted within or proximate to the barrel 12 of the weapon simulator 8 in the same general area allocated for a conventional laser apparatus 16 of a conventional weapon simulator. More particularly, when the laser apparatus 16 is inserted into the barrel 12 (as generally guided by a tab 25 engaging a barrel slot 19), the laser stabilization assembly 10 is mounted within or proximate the barrel 12 of the weapon simulator 8 to securely position the laser apparatus 16.

In assembling the laser stabilization assembly 10, the first or proximal spacer 14 may be installed in the barrel 12 independently of the laser apparatus 16, wherein the laser apparatus 16 is then connected to the proximal spacer 14. On the other hand, the wired connections 15 of the laser apparatus 16 may be fitted through the first or proximal spacer 14 to be connected with a control module 17. Since the wired connectors 15 are fit through the first spacer or proximal spacer 14, the first or proximal spacer 14 and the laser apparatus 16 may be jointly installed in the barrel 12. Once the first or proximal spacer 14 and laser apparatus 16 are mounted within the barrel 12, the second or distal spacer 18 is mounted in the barrel 12 proximate the laser apparatus 16 on the end of the laser apparatus 16 that is opposite the first or proximal spacer 14. The first and second spacers 14, 18 therefore form a mounting combination for the laser apparatus 16.

The mounting combination is seated in the barrel 12 by installing a threaded barrel guide 20 (see FIGS. 9*a* and 9*b*). That is, the user will apply a predetermined settling compression (equated to turns of thread rotation) and allow the components or mounting combination to settle. The amount of turns of the threaded guide 20 will be dependant on the threads per inch and hardness and size of the distal spacer 18. The threaded guide 20 is then removed and a general purpose threadlocker or adhesive is applied to the threads within the barrel 12 to control lubricity for accurate clamp loads and secure threads. The threaded guide 20 is then installed within the barrel 12 to a position barely touching the second or distal spacer 18, and a predetermined mounting compression is subsequently applied. A barrel sleeve 23 is then slid around the barrel 12, including the distal spacer 18. The lock ring 22 is then installed over the threaded guide 20 and adjacent to the barrel 12. While preventing the guide 20 from movement using a slot 21 at the end of the threaded guide 20, the lock ring 22 is torque secured/jammed against the barrel 12 and further secured by using the threadlocker or related adhesive and removable screws 24. The removable screws 24 are inserted on the sides of the lock ring 22, which will further secure the laser stabilization assembly 10 to the firearm barrel 12 in addition to the adhesive.

The first or proximal spacer 14 may be made of a strong resin material such as acetal polyoxymethylene (which is commonly referred to by the federally registered trademark Delrin). Such resins offer superior mechanical properties including high strength and rigidity over a broad temperature range, toughness and resistance to repeated impact and good electrical insulation. Components made from materials such as acetal polyoxymethylene have many of the same characteristics of industrial metals such as brass, aluminum, zinc, and stainless steel. Some comparable properties include stiffness, dimensional stability, impact resistance, and structural strength. These properties have led acetal polyoxymethylene to replace many industrial metals in various applications. More specifically, acetal polyoxymethylene is an outstanding general purpose mechanical plastic, and is popular for its versatility. It has good overall mechanical properties, dimensional stability, low moisture absorption, and chemical resistance. In making the first spacer 14 of a material such as acetal polyoxymethylene, the laser stabilization assembly 10 is able to provide a perfect stop to laser apparatus 16 when the weapon simulator 8 is actually fired and recoil is created.

Looking to FIG. 4, the first spacer 14 of one embodiment has an outer diameter of approximately 0.469 inches, an inner diameter of approximately 0.312 inches, and a length of approximately 0.200 inches. Of course, these dimensions could be changed according to the style of weapon simulator 8 of the weapon simulator assembly.

The second or distal spacer 18 may be made of material such as a polyurethane. Polyurethane materials are considered somewhat elastic, abrasion and chemical resistant, and can be produced in a wide range of hardness. Because polyurethane provides more "give", it acts as a shock absorber for the laser apparatus 16. The hardness of the material chosen is dependant on the required damping and compression. The second or distal spacer 18 is positioned at the forward end of the weapon simulator 8, away from the stock 6, such that when the simulator with forward shock is fired, the shock will be absorbed by the second or distal spacer 18. With a simulator having shock in the opposite direction, the first or proximal spacer 14 would be made of a material such as polyurethane, while the second or distal spacer 18 would be made with a material such as acetal polyoxymethylene.

In the embodiment illustrated in FIG. 3, the second spacer 18 has an outer diameter of approximately 0.469 inches, an inner diameter of approximately 0.250 inches, and a length of approximately 0.500 inches. As is to be expected, these dimensions could be changed according to the style of weapon simulator 8 of the weapon simulator.

Referring to FIG. 7, it is to be noted that the barrel 12 of a preexisting weapon simulator 8 may be retrofitted to receive the present invention. More specifically, the laser apparatus 16 connected to the barrel 12 may be removed, and the barrel 12 may be threaded to receive an adapter 27 of a variation of the laser stabilization assembly 10. The adapter 27 and the laser stabilization assembly 10 may then be installed as with other weapon simulators 8.

A further embodiment of the present invention is illustrated in FIGS. 8*a*-8*d*, wherein an alignment tab 26 is used to engage the laser apparatus 16 to prevent rotation of the laser apparatus 16. The alignment tab 26 is preserved for laser alignment (preventing undesired rotation). That is, the alignment tab 26 helps to prevent undesired rotation of the laser apparatus 16 while it is being fit with the barrel 12, and may be cut off just prior to the installation of the laser apparatus 16. Looking further to the exploded view of FIG. 8*a*, the proximal spacer 14 may include prongs 14*a* that are used to engage a recess 16*a* in the laser apparatus 16 (see FIG. 8*d*). These prongs 14*a*, with the alignment tab 26 and clamping forces on the laser apparatus 16, will help prevent rotation of the spacer 14. A flash suppressor adaptor 28 may further be incorporated as illustrated in FIG. 8*a*. Looking to FIGS. 8*a*-8*c*, a pair of O-rings 30 may additionally be provided around the laser apparatus 16 to prevent lateral movement of the laser apparatus 16 within the barrel 12 (the diameter of the barrel 12 will be increased slightly to take the compressed O-rings 30).

While the laser stabilization assembly 10 is illustrated in the attached figures in use with an SRS assault rifle simulator, it is to be noted that it may be incorporated into any number of other firearm designs and firearm frames. The present design may be used in any weapon simulator as needed to stabilize the laser apparatus 16 mounted therein or thereto.

While this invention has been described with reference to preferred embodiments thereof, it is to be understood that variations and modifications can be affected within the spirit and scope of the invention as described herein and as described in the appended claims.

What is claimed is:

1. A laser stabilization assembly for securely positioning a laser apparatus proximate a barrel of a weapon simulator, the laser apparatus having a first end and a second end, said laser stabilization assembly comprising:

a first spacer installed in the barrel to engage the first end of the laser apparatus;

a second spacer installed in the barrel to engage the second end of the laser apparatus;

a threaded insert; and a lock ring that is secured to the barrel of the weapon simulator via said threaded insert;

said first spacer and said second spacer securing the laser apparatus to the weapon simulator.

2. The laser stabilization assembly as described in claim 1, wherein said first spacer has a first hardness and said second spacer has a second hardness.

3. The laser stabilization assembly as described in claim 2, wherein said hardness of said first spacer is greater than said hardness of said second spacer when the weapon simulator has a forward shock when fired.

4. The laser stabilization assembly as described in claim 3, wherein said first spacer comprises an acetal polyoxymethylene material and said second spacer comprises a polyurethane material.

5. The laser stabilization assembly as described in claim 1, wherein said hardness of said second spacer is greater than said hardness of said first spacer when the weapon simulator has a rearward shock when fired.

6. The laser stabilization assembly as described in claim 1 further comprising a barrel sleeve surrounding the barrel and secured by said lock ring.

7. An apparatus for stabilizing a laser instrument with a weapon simulator having a barrel to maintain a desired position, the laser instrument having a proximal and distal end, said apparatus comprising:

a proximal spacer connected to the proximal end of the laser instrument;

a distal spacer connected to the distal end of the laser instrument;

a threaded insert; and a lock ring that is secured to the barrel of the weapon simulator via said threaded insert;

said first spacer and said second spacer securing the laser instrument to the weapon simulator.

8. The apparatus as described in claim 7, wherein said proximal spacer has a first hardness and said distal spacer has a second hardness.

9. The apparatus as described in claim 8, wherein said hardness of said proximal spacer is greater than said hardness of said distal spacer when the weapon simulator has a forward shock when fired.

10. The apparatus as described in claim 9, wherein said proximal spacer comprises an acetal polyoxymethylene material and said distal spacer comprises a polyurethane material.

11. The apparatus as described in claim 8, wherein said hardness of said distal spacer is greater than said hardness of said proximal spacer when the weapon simulator has a rearward shock when fired.

12. The laser stabilization assembly of claim 7 further comprising a barrel sleeve surrounding the barrel and secured by said lock ring.

13. A method for securing a laser apparatus having a first and second end to a barrel of a weapon simulator, said method comprising the steps of:

a) engaging the first end of the laser apparatus with a first spacer;

b) installing said first end and the laser apparatus in the barrel of the weapon simulator;

c) affixing a second spacer to the second end of the laser apparatus to complete a mounting combination; and d) installing a threaded guide within the barrel to a position to support said second spacer.

14. The method as described in 13, wherein after step c), further comprising the step of:

applying a settling compression to said second spacer to settle said mounting combination.

15. The method as described in 13, wherein after step d), further comprising the step of:

slipping a barrel sleeve around the barrel; and securing said barrel sleeve to the barrel with a lock ring.

16. The method as described in 13, wherein step a) further comprises the steps of:

inserting power connectors for the laser apparatus through said first spacer; and connecting the laser apparatus to a control module.

* * * * *